US008935894B1

(12) United States Patent
Classen

(10) Patent No.: US 8,935,894 B1
(45) Date of Patent: Jan. 20, 2015

(54) CONCRETE STEP

(71) Applicant: David William Classen, Manassas, VA (US)

(72) Inventor: David William Classen, Manassas, VA (US)

( * ) Notice: Subject to any disclaimer, the term of this patent is extended or adjusted under 35 U.S.C. 154(b) by 0 days.

(21) Appl. No.: 14/026,495

(22) Filed: Sep. 13, 2013

(51) Int. Cl.
*E04F 11/116* (2006.01)
*E04F 11/09* (2006.01)

(52) U.S. Cl.
CPC ..... *E04F 11/09* (2013.01)
USPC ..... 52/189; 52/742.14

(58) Field of Classification Search
USPC ..... 52/182, 183–191, 742.1, 742.13, 52/742.14
See application file for complete search history.

(56) References Cited

U.S. PATENT DOCUMENTS

| | | | | | |
|---|---|---|---|---|---|
| 1,078,403 | A * | 11/1913 | Anderson | 52/188 |
| 3,370,387 | A * | 2/1968 | Sivley | 52/188 |
| 3,839,840 | A * | 10/1974 | Miller | 52/741.2 |
| 4,893,442 | A * | 1/1990 | Graham et al. | 52/184 |
| 5,511,347 | A * | 4/1996 | Schwarz | 52/182 |
| 2005/0210775 | A1 * | 9/2005 | Grinstead | 52/182 |
| 2009/0293385 | A1 * | 12/2009 | Vargas | 52/191 |

FOREIGN PATENT DOCUMENTS

| | | |
|---|---|---|
| WO | WO 96/14483 | 5/1996 |

* cited by examiner

*Primary Examiner* — William Gilbert
(74) *Attorney, Agent, or Firm* — Whitham, Curtis, Christofferson & Cook, P.C.

(57) ABSTRACT

A concrete step has a trough with a base and two side walls. The side walls project upwardly from the base and are positioned at opposite ends of the base. At least one of the sidewalls has an inwardly projecting flange spaced away from the base by approximately the height of the step. Concrete fills the trough at least up to the inwardly projecting flange, and together a top surface of the concrete and at least a portion of the inwardly projecting flange form a top surface/tread of the step.

12 Claims, 6 Drawing Sheets

CONCRETE STEP

FIELD OF THE INVENTION

The invention generally relates to concrete steps and staircases made thereof.

BACKGROUND

Concrete steps have long been relied upon for their strength, durability, and even aesthetics. The general use of "concrete" as a building material can be traced back to ancient Rome, where, like today, it was desirable to produce hardened structures of predetermined shape, size, and configuration from base materials easier to transport and manipulate as compared with, for example, naturally occurring stone or rock. In modern society, the compositions and uses of concrete have advanced significantly from Roman times, as might be expected.

One important advancement was the introduction of embedded supporting elements, such as rebar (i.e. reinforcement bar; reinforcing steel). Concrete, although possessing considerable compressive strength, has notably poor tensile strength. Rebar, generally made of steel rods, are frequently placed in molds, forms, etc. into which concrete will be added. The concrete structure is formed about the rebar, which serves to "absorb" tensile loads on the concrete. This significantly reduces the susceptibility of the concrete to fracture and breakage.

Today a commonly employed method for concrete manufacture is precasting. Reusable molds can be used to produce hundreds of identical standardized articles of concrete, such as precast wall slabs or precast concrete steps. Precasting is generally done in a centralized facility, and articles for individual construction applications are transported to their final destinations ready for use immediately after installation. Embedded rebar is critical in all such articles to meet requirements for load strengths and durability in both transportation and use.

The use of rebar or other embedded supporting elements carries with it certain drawbacks. In addition to material and transportation costs, rebar must be arranged in the desired configuration prior to pouring of wet concrete. Furthermore, rebar corrodes and weakens the concrete in its immediate vicinity such that localized breakdown of concrete is often observed. In the case of precast concrete steps, it is not uncommon for long fractures to form on a surface or side of the step adjacent and parallel to one or more bars of embedded rebar.

Edges formed by concrete, in particular the edges on concrete steps, experience little to no benefit from embedded rebar. Rebar helps absorbs overall deformation and fracture of a concrete article under tensile loading, but it does not offer any advantages to combat the routine localized loading and wear which occurs on surfaces and edges of the concrete structure. Cracking and crumbling are a pervasive problem with concrete edges, such as those of precast concrete steps.

SUMMARY

A concrete step and methods for making the same are provided which can reduce or eliminate the need for rebar or other embedded supporting elements. Furthermore, problems of cracking and/or crumbling of edges of a concrete step may also be reduced or overcome according to embodiments of the present invention.

Generally, a concrete step according to the invention includes a trough with concrete filling the trough. The trough has a base and two sidewalls projecting upwardly from the base. At least one of the two sidewalls has an inwardly projecting flange. In general, the trough is provided with a plate at each end. This is particularly instrumental for retaining wet/unset concrete which fills the trough during manufacture. End plates, together with the trough, can provide a self contained step with all four sides and a bottom enclosed/protected. Each plate may have a pair of weepholes at bottom corners thereof to allow water to escape from the trough. This is useful for drainage of excess water in the unset concrete mix or any water which gets between a trough wall and the concrete. A suitable material for the trough is metal, for example a sheet metal which can be bent to form at least the base, sidewalls, and inwardly projecting flanges.

Concrete fills the trough at least up to each inwardly projecting flange. A top surface of the step (i.e. tread) is thereby formed consisting of the exposed top surface of the concrete and top portions of the inwardly projecting flanges. In contrast to conventional precast concrete steps, embodiments are provided with concrete edges which are not exposed to direct wear, loading, etc. Furthermore, due to structural support provided by the trough, embedded supporting elements such as rebar are not necessary and thus their drawbacks (e.g. rebar corrosion) may be avoided.

Concrete steps according to the invention may be filled with unset concrete either on site (i.e. at the location where the step will be installed for use) or in a remote location, such as at a precasting manufacturing facility.

One embodiment of the invention includes a staircase which generally includes two stringers, one or more concrete steps, and at least two support members for each step.

DETAILED DESCRIPTION

Figure 1A:
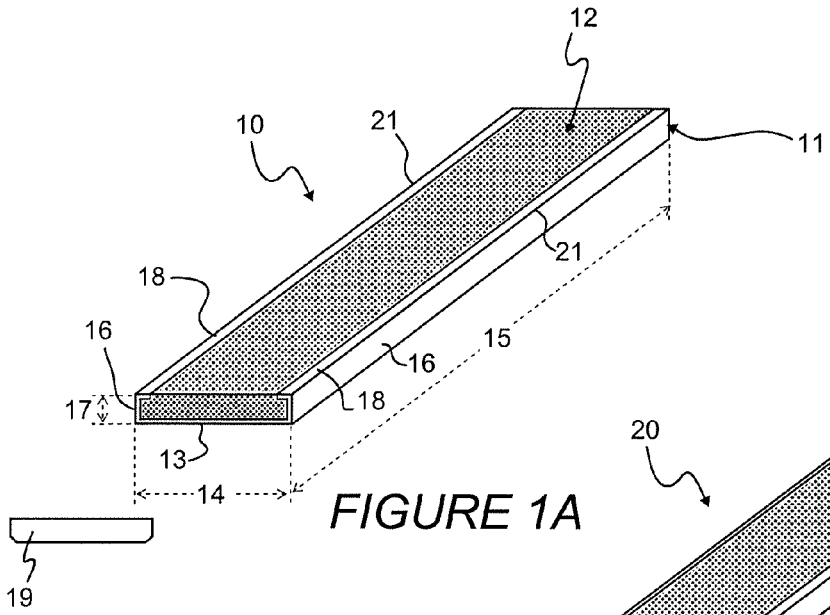
FIGS. 1A-1C show three embodiments of a concrete step.
Figure 1B:
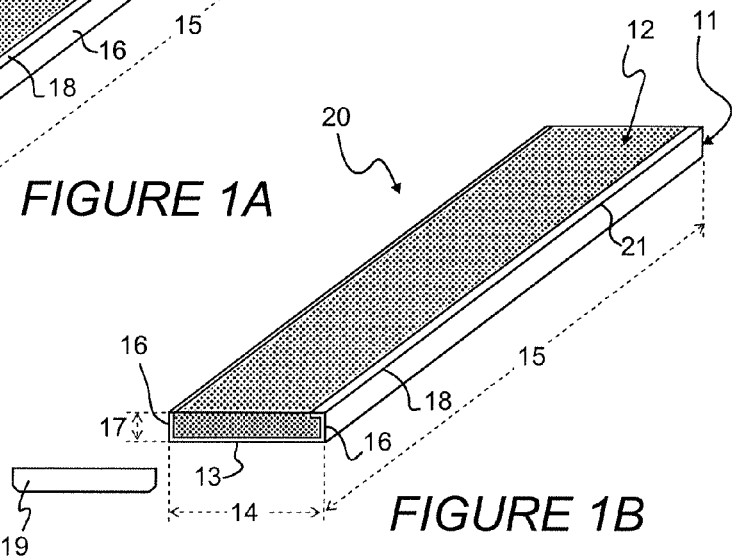
Figure 1C:
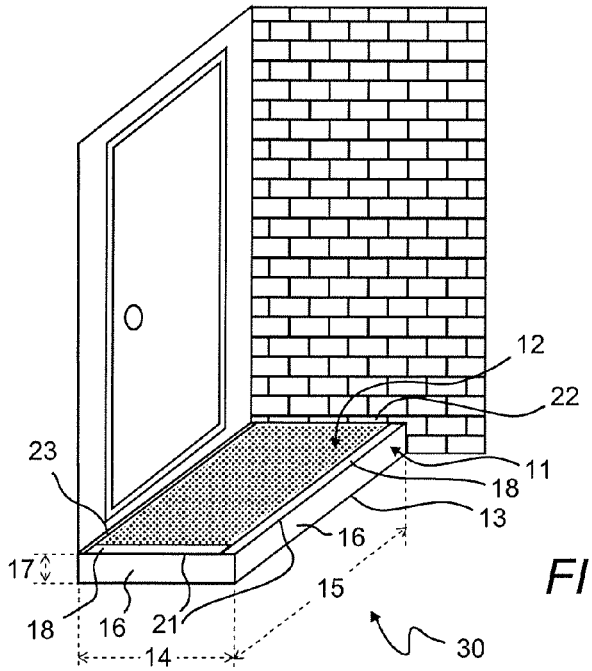

Referring to the drawings and more particularly FIGS. 1A-1C, three exemplary embodiments of a concrete step are shown. Concrete steps 10, 20, and 30 each have a trough 11 with concrete 12 filling the trough. The trough has a base 13 having a width dimension 14 and a length dimension 15 and two sidewalls 16 projecting upwardly from the base in a height dimension 17. In some embodiments, base 13 is substantially a uniform plane, furthermore a plane which is substantially parallel with the tread of the step and spaced from the tread by height dimension 17. At least one of the two sidewalls 16 has an inwardly projecting flange 18 spaced away from the base by the height dimension 17. FIG. 1A shows step 10 with two sidewalls 16 being positioned at opposite ends of the base 13 in the width dimension 14. Each of the sidewalls has a flange 18 projecting inwardly. FIG. 1B shows step 20 with only one sidewall having a flange 18, and FIG. 1C shows a step 30 with two sidewalls 16 each with a flange 18. Step 30 differs from step 10 in that sidewalls 16 of step 30 are adjacent one another, one being provided in the width dimension 14 and the other being provided in the length dimension 15. An end plate 19 is generally affixed on either open end of a trough 11. These are shown pulled away in FIGS. 1A and 2A to more clearly show other features of the concrete steps. Generally, a step 10 has the advantage over a step 20 in that it minimizes total edge perimeter into which water may penetrate. It is preferred that little to no water get between the trough and the concrete. For a step having two opposing flanges 18 such as step 10, water cannot significantly penetrate between a wall of the trough and the adjacent concrete except at the ends of the step in the longitudinal direction.

An inwardly projecting flange 18 together with a sidewall 16 serve the advantage of wrapping and protecting a portion or entirety of an exposed edge of a concrete step. In contrast to conventional precast concrete steps, fewer edges of the concrete are exposed. In some embodiments, there are no exposed concrete edges. In the case of step 10, both the front and back longitudinal edges 21 of the step are effectively wrapped or encased by the combination of the sidewalls 16 and their respective inwardly projecting flanges 18. "Edge", as used herein, generally refers to a portion of the step where a horizontal surface of the step (e.g. the step tread) and a side surface (possibly including a riser) meet. Flanges 18 are generally desirable on at least those edges of a step which are subject to loading, such as from users ascending or descending the step, or which otherwise lack external support. The step 30 in FIG. 1C is shown arranged in the corner of a building. Externally-unsupported edges 21 are provided with flanges 18, while edges 22 and 23 do not have flanges and are instead supported by exterior walls of a building. In an alternative embodiment, a concrete step may have up to all edges defining the top surface/tread of the step wrapped by an inwardly projecting flange.

In an exemplary embodiment, for example that which is shown in FIG. 1A, the width dimension 14 is approximately 11 inches (an exemplary range being 6-20 inches), the height dimension 17 is approximately 2 inches (an exemplary range being 1.5-2 inches), and the length dimension 15 is approximately 3 feet (an exemplary range of up to 4 feet). It is worth noting that conventional precast concrete steps typically require a 2.5 inch height to be of sufficient strength and durability under human traffic. The current invention makes possible shorter height dimensions (e.g. less than 2.5 inches) without significantly reducing the strength and durability of a concrete step.

Each flange 18 projects inwardly in the width dimension by approximately 1 inch (an exemplary range being at least 1 inch). Those of skill in the art will readily recognize that the dimensions of a trough, including width dimension, height dimension, length dimension, and flange size may vary between embodiments. Furthermore, while steps 10, 20, and 30 are shown as having a three dimensional shape of roughly a rectangular prism and a step tread generally rectangular, a concrete step according to the teachings herein may take any one of many prismatic three dimensional shapes and polygonal tread shapes, including trapezoids, triangles, squares, and polygons. Generally, the present invention can take any shape corresponding to conventional precast concrete steps.

Furthermore, use of the terms length dimension, width dimension, and height dimension is not meant to be limiting, and those of skill in the art will recognize that such terms and respective measures may be supplemented or substituted with appropriate terms and respective measures for other polygonal shapes consistent with known step designs. Referring to the side view appearance of trough 11 shown in FIGS. 2A-2C, edges 30, 31, 32, and 33 may take any radius of curvature, although it is preferred that a majority of base 13 be substantially planar and located beneath the center of mass of the overall concrete step 10. In the embodiments shown in FIGS. 1A-1C, the radii of curvature for trough 11 are shown as close to zero, i.e. forming approximately right angles. It is worth noting that more curvature, in particular for one or more edges 21, may be desirable to reduce the risk of injury or damage should a person or object fall and strike an edge 21. Appropriate radii of curvature for each edge of a concrete step according to the invention may be selected according to factors including but not limited to the size of the step, the intended environment of use, the capabilities of the manufacturing facility (e.g. the radii obtainable by sheet metal bending apparatuses), desired aesthetics, etc. An advantage of a concrete step according to the invention over conventional precast concrete steps can be the ability to have an edge with a radius, or even another shape which is not a uniform rounding, which is not possible with a bare exposed concrete edge. The trough provides structural support and rigidity that allows for variations in design not normally possible with concrete lacking such an "exo-skeleton".

Figure 2A:
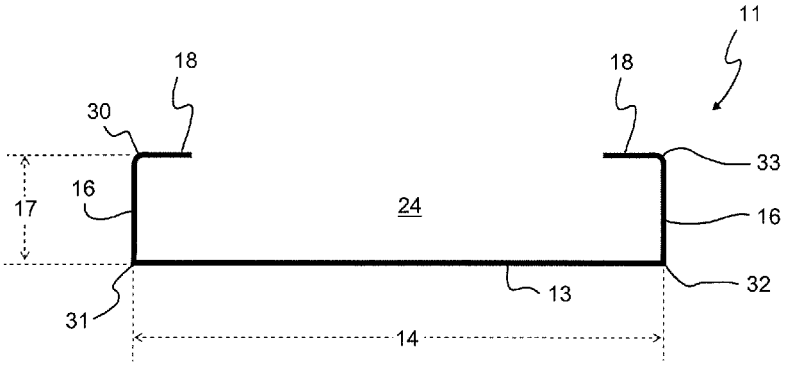
FIGS. 2A-2C show, respectively, an empty trough with open ends, a filled trough with open-ends, and a filled trough with an affixed plate on an end thereof.
Figure 2B:
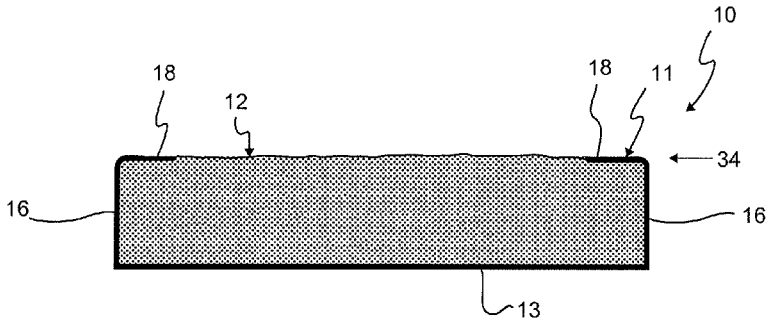
Figure 2C:
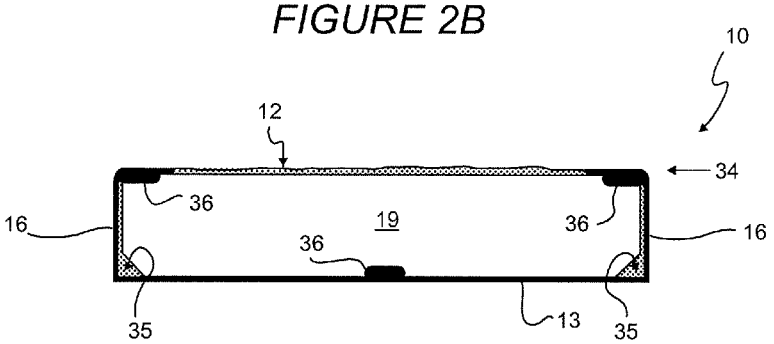

Referring now to FIGS. 2A-2C, a trough 11 for a step 10 is shown. Features corresponding with those identified in FIGS. 1A-1C are indicated with the same reference numerals. FIG. 2A shows a trough 11 without concrete as seen from the side (i.e. looking down the length dimension). In an embodiment, a trough 11 is made of metal, preferably steel. However, trough 11 may be made from other materials and composites, including polymers and ceramics, as desired. A suitable material may be selected according to various requirements (architectural, aesthetic, cost, etc). To form a metal trough 11, a single sheet of sheet metal (e.g. 14 gauge sheet metal) may be bent to form at least a base 13, sidewalls 16, and inwardly projecting flanges 18 of a trough with two open ends. Base 13 and sidewalls 16 provide for a hollow or cavity 24. A base and sidewalls for a trough 11 may also be provided as initially independent pieces which are then fixedly attached to one another by welding, for example. Embodiments of concrete steps exceeding 4 feet in length are possible, although it is preferred in such cases that a higher strength material be used for the trough (e.g. an 11 gauge sheet metal).

The cavity 24 of the trough is filled with concrete at least up to the inwardly projecting flanges 18. Wet concrete is retained within the trough by plates 19 affixed on either open end of the trough (e.g. the two opposite open ends of trough 11 in the length dimension 15). After the concrete has been allowed to set, the plates may be removed but preferably remain in place in order to provide a self-contained step having, for example, protection of all four vertical sides and the bottom from impact, breakage, etc. FIG. 2B is an end profile to a step 10 with no end plate shown.

In order to allow drainage of excess water of unset concrete or any water which gets between a trough wall and the concrete filling, a trough 11 may be provided with one or more weep holes in a bottom portion thereof. In such embodiments, it is furthermore advantageous to provide at least one weep hole at each end of the trough in the length dimension. Alternatively, a plate 19 may provide for one or more weep holes, for instance a pair of weep holes 35 at bottom corners of the plate. FIG. 2C shows two approximately triangular weep holes 35 at the corners of step 10, weep holes 35 being formed by corner cutouts from plate 19.

A plate 19 may be fixedly attached to trough 11 by a fixing means such as welding or may be integrally formed with the base, such as for embodiments where a single piece of sheet metal is bent to provide base 13, sidewalls 16, and plates 19. FIG. 2C shows a plate 19 fixedly attached to trough 11 by weld spots 36 produced via a discontinuous weld similar to a tack weld. One of skill in the art will recognize that the size and shape of a plate 19 is preferably selected in connection with (e.g. similar to) at least the width and height dimensions of the trough 11 so as to significantly cover an end of the trough. For the example dimensions provided above in connection with step 10 (FIG. 1A), an example set of plate dimensions is a 10.875 inch width and a 2 inch height. This may be cut or otherwise produced from, for example, a sheet metal of 0.125 inch thickness.

It is preferred that concrete 12 be filled at least up to flanges 18 such that together a top surface of concrete 12 and at least a portion of inwardly projecting flange(s) 18 form a top surface 34, or tread, of the step. While FIGS. 1A-1B show the top of flange(s) 18 even/level with the top of concrete 12, the concrete 12 could extend slightly above the top of the flange (s) in some applications. In addition, the top of a flange 18 could be made in decorative shapes in some applications in addition be being a rectangle as in FIGS. 1A-1B. The top exposed surface of concrete 12 may furthermore be finished with one or more surface treatments, including addition of textures or patterns (e.g. for improved traction properties), paint, and/or sealant. Similarly, the exposed/exterior surfaces of the trough 11 may be finished with one or more surface treatments, including metal oxidation (such as for steel), anodization (such as for aluminum), and/or paint (e.g. a textured paint to reduce the risk of a user slipping during use). Such treatment may be performed before and/or after filling the trough with concrete.

An advantage of a concrete step according to the invention is that rebar (i.e. reinforcement bar; reinforcing steel) or similar embedded supporting elements and materials are not typically required. The trough provides a general "exoskeleton" to the step, supplying strength (e.g. tensile strength) for which rebar is conventionally relied upon. This is a unique advantage over prior art such as conventional precast steps. While rebar and/or other supportive and filler materials may still be used if desired, it is preferred that rebar is not used since water (e.g. from the concrete) can corrode the rebar and eventually degrade the concrete step. Furthermore, any of a number of known concrete formulations may be used in the practice of the invention. The use of the term "concrete" is not intended to be limiting, and any additives, modifications, or substitutions for materials in the filling composition which would be apparent to one of skill in the art may be employed in accordance with the invention.

Concrete steps may be filled with concrete either on-site (i.e. at the location where the step is installed for use) or in an off-site location, such as at a precast manufacturing facility. This versatility is an advantage from the prior art. The latter offers the advantage of possible or improved regulation of environmental conditions (e.g. humidity, temperature, etc) for setting the concrete.

Figure 3:
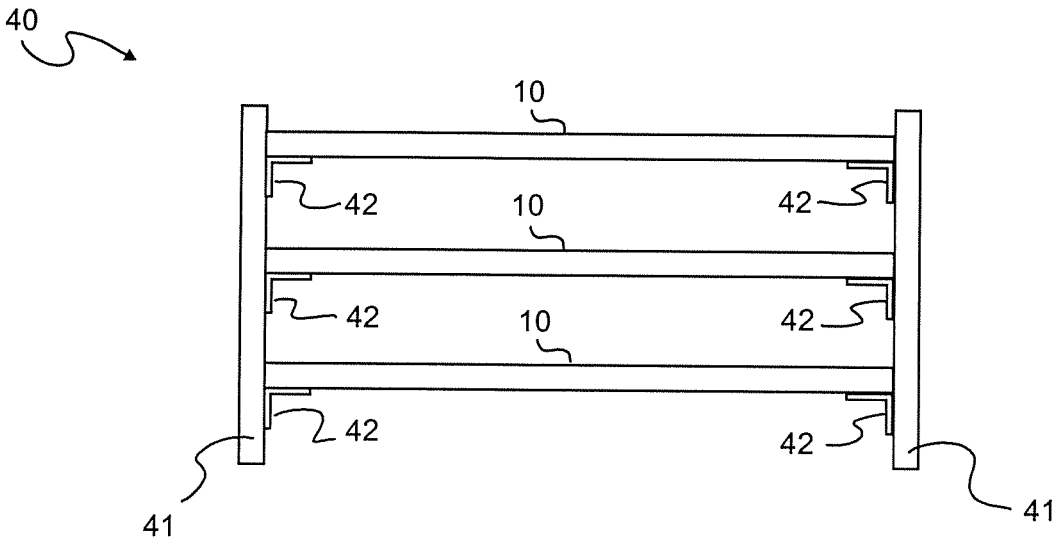
FIG. 3 shows a front elevational view of an open staircase with three concrete steps.
Figure 4:
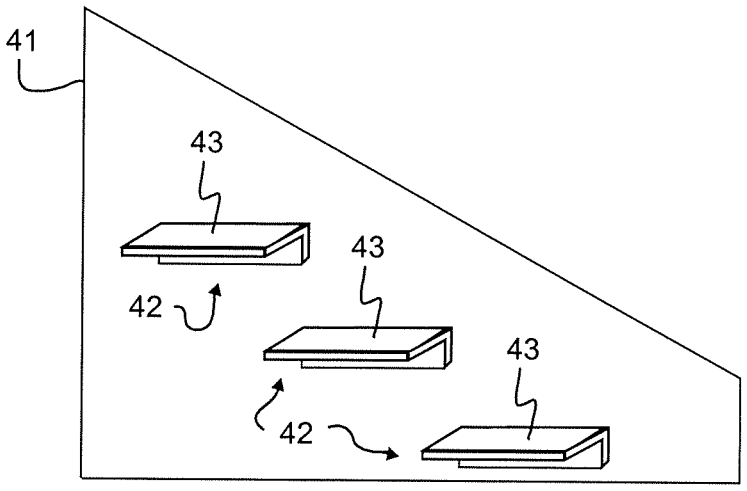
FIG. 4 shows a stringer and support members thereon for three concrete steps.
Figure 5:
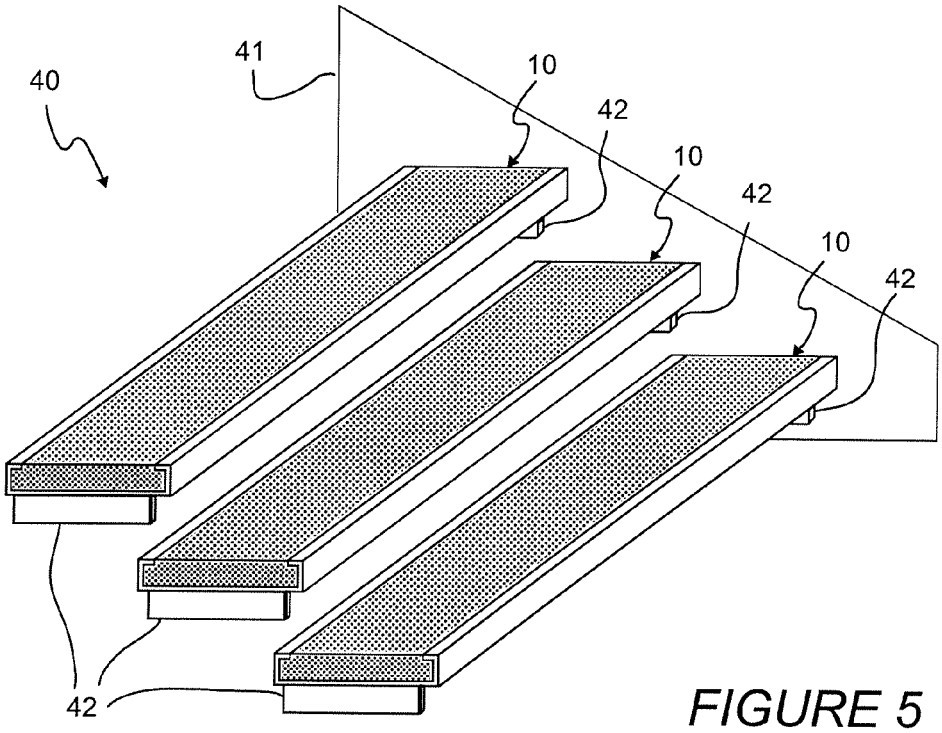
FIG. 5 shows a staircase with three concrete steps, one stringer not being shown.

Referring now to FIGS. 3 through 5, a staircase 40 made of at least one concrete step 10 generally includes at least two stringers 41, the desired number of steps (one or more), and at least two support members 42 for each step. Support members 42 provide connection means between the stringers 41 and the concrete steps 10. Generally, the support members are fixedly attached to the stringers, such as by welding. Support members are arranged in opposing pairs, with each member of a pair being affixed to one of the two stringers such that the two members project outwardly from their respective stringers toward the other of the two stringers. Three pairs of support members 42 are shown in FIG. 3.

Conventional precast concrete steps have metal projections, such as threaded shafts, end portions of which are embedded within the concrete during casting. As a result, the projections have fixed locations. In order to install a conventional precast step, the projections must be aligned with holes in support members, assuming such alignment is even possible. In many cases, new holes must be drilled into support members or existing holes expanded in order to accommodate variations in the rigidly fixed locations of precast step projections. An ability to adjust the relative location and spacing of consecutive steps is also reduced as a result of fixed locations of both the projections in the conventional step and the holes in the supporting members.

Certain embodiments of the invention overcome these limitations of conventional precast steps in terms of using them in a staircase.

FIG. 4 shows support members 42 having load bearing surfaces 43 which, in one embodiment of the invention, are substantially planar and continuous. Although load bearing surfaces 43 may have holes (not shown), they are not required or necessary. In contrast to the projection-hole installation common with conventional precast concrete steps, a concrete step 10 of the present invention may be installed simply by setting a step 10 atop a pair of opposing support members and fixedly attaching the step to the support members by suitable attachment means (e.g. welding).

Referring to FIG. 5, it is preferred that the width dimension 14 of step 10 is greater than a width dimension 44 of support member 42 such that the position of step 10 may be adjusted relative the support member and shifted in the width direction without exposing the load bearing surface 43 of a support member 42. In the embodiment shown, base 13 of the step and the load-bearing surfaces 43 of the two supporting support members are substantially flush planes, and adjustment may be made by simply sliding base 13 forward or backward (i.e. along the width dimension). Once a desired location is attained, the step 10 may be welded or otherwise fixedly attached to the support members. Note that FIG. 5 does not show end plates 19 on steps 10 for clarity. End plates 19 would generally be present.

Figure 6:
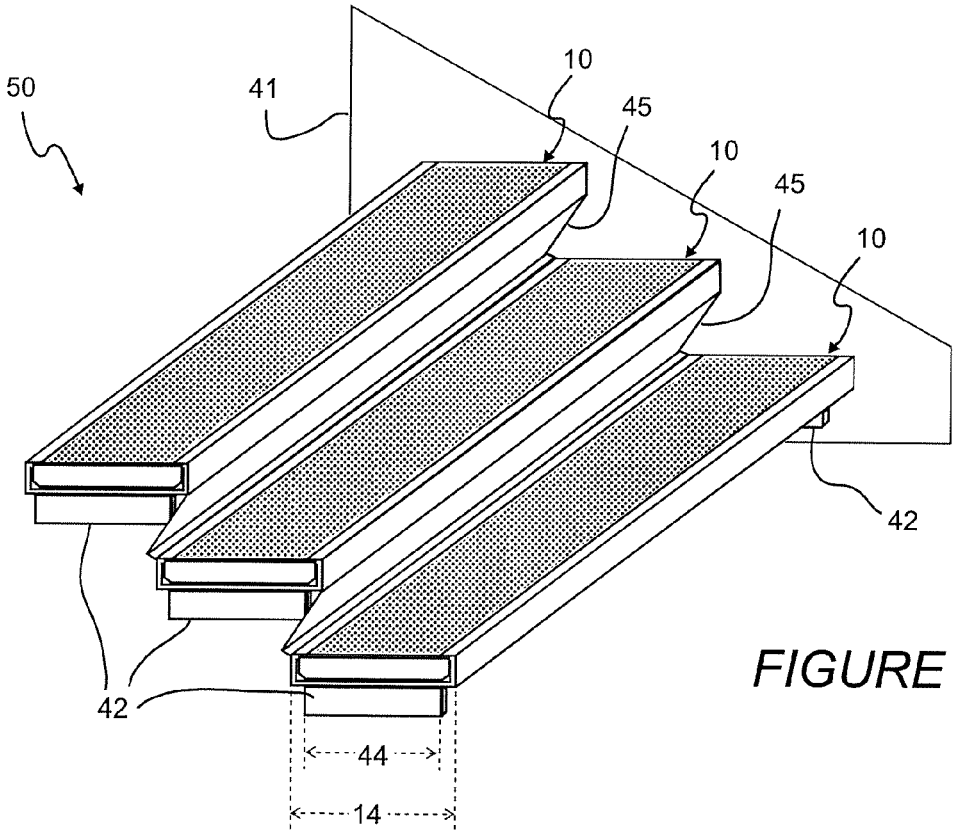
FIG. 6 shows a staircase with three concrete steps with a riser between each pair of consecutive steps, one stringer not being the shown.

FIG. 6 shows a staircase 50 having multiple concrete steps 10 and a riser 45 between each of two consecutive concrete steps. Riser 45 may be of any suitable material, such as a metal or a polymer. It is preferably rigidly fixed to either or both the two adjacent steps, such as by welding in the case both a riser 45 and trough 11 of a step 10 are made of metal. A staircase may be without risers, such as in FIG. 5, or with partial or full risers, such as in FIG. 6. Furthermore, virtually every possible staircase design may be implemented with the current invention, including but not limited to staircases with steps of different dimensions, staircases with landings and more than two risers, and helical staircases. In the latter scenario, a stringer may be understood to mean a center shaft of the helical space in which the staircase is installed. In some embodiments, support members 42 and one or more stringers 41 may also be integral.

Figure 7:
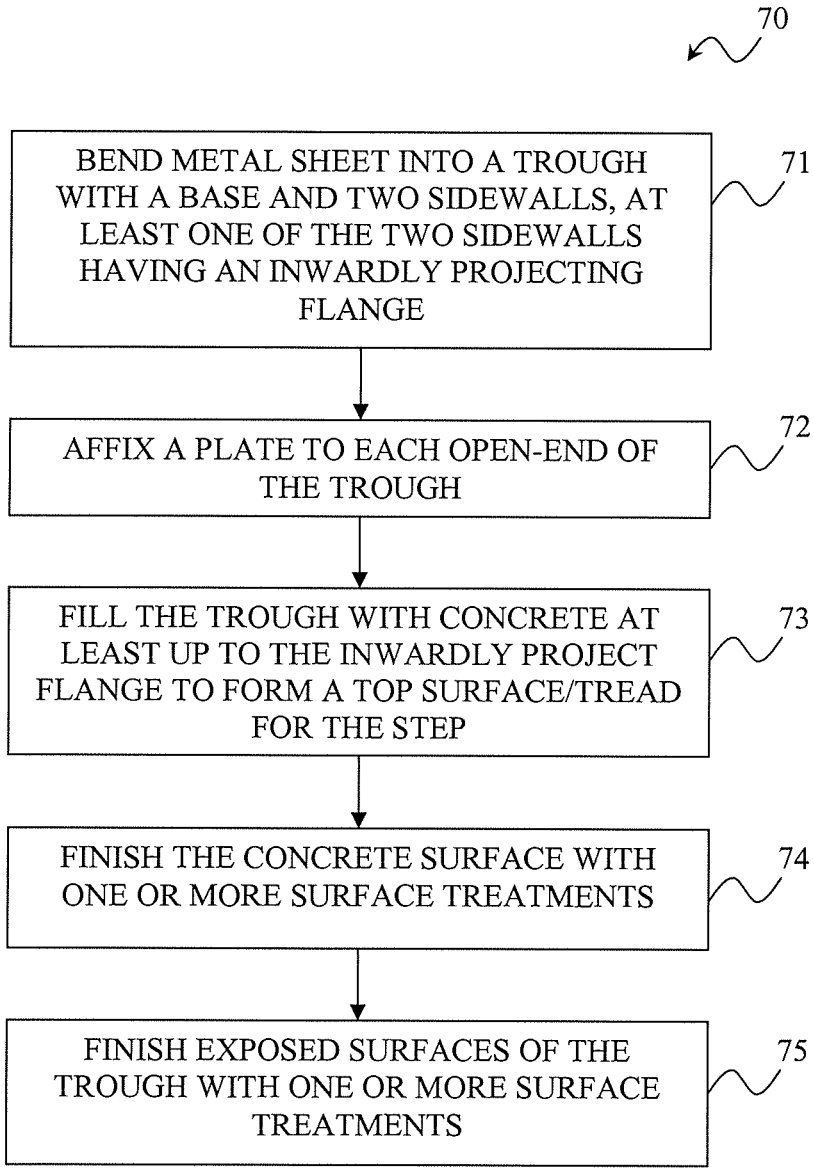
FIG. 7 is a method for making a concrete step.
Figure 8:
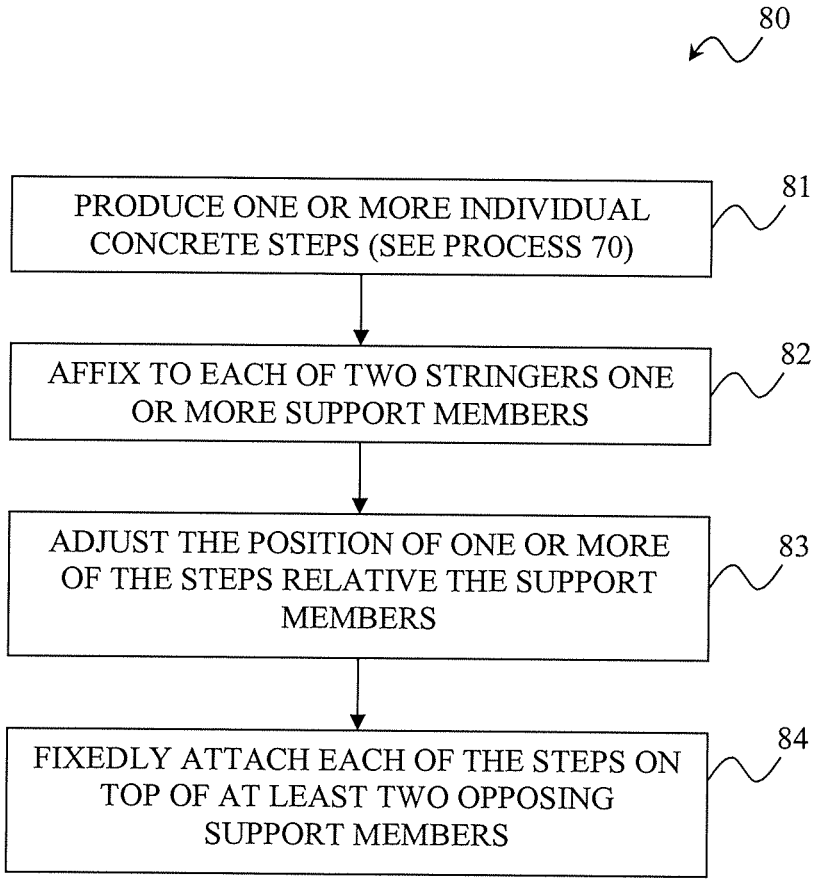
FIG. 8 is a method for making a staircase having one or more concrete steps.

FIGS. 7 and 8 show, respectively, flow diagrams for a process 70 for making a concrete step and a process 80 for making a staircase comprising one or more concrete steps.

Although these processes have been explained above in connection with the structural features of the invention, they may be summarized as follows.

Generally, a concrete step may be produced by all or a subset of the following procedural steps:

(step 71) bending a metal sheet into a trough, the trough having open-ends, a base having width and length dimensions, and two sidewalls projecting upwardly from the base in a height dimension and positioned at opposite ends of the base in the width dimension, at least one of the two sidewalls having an inwardly projecting flange spaced away from the base by the height dimension (this may be accomplished by press molding or other suitable techniques);

(step 72) affixing a plate to each open-end of the trough;

(step 73) filling the trough with concrete at least up to the inwardly project flange such that the concrete and at least a portion of the inwardly projecting flange form a top surface/tread for the step;

(step 74) finishing said concrete with one or more surface treatments; and (step 75) finishing exposed surfaces of said trough with one or more surface treatments.

Generally, a staircase made of one or more concrete steps may be produced by all or a subset of the following procedural steps:

(step 81) producing one or more individual concrete steps according to process 70;

(step 82) affixing to each of two stringers one or more support members;

(step 83) adjusting at least one of said one or more steps in said width dimension relative said one or more support members, said one or more support members each having a width dimension which is less than said width dimension of said trough; and (step 84) fixedly attaching each of the one or more steps on top of at least two opposing support members, each of the two opposing support members being on an opposing stringer of the two stringers.

It should be noted that for both processes 70 and 80 above, the listing of steps need not necessarily be performed in the sequence indicated. In particular, finishing of exposed surfaces of the trough may be performed at essentially any point during the production process. Furthermore, steps or subsets of steps from either process may be performed at varying times and/or locations, as will be apparent to those of skill in the art.

While preferred embodiments of the present invention have been disclosed herein, one skilled in the art will recognize that various changes and modifications may be made without departing from the scope of the invention as defined by the following claims.

Having thus described my invention, what I claim as new and desire to secure by Letters Patent is as follows:

1. A concrete step, comprising:

a trough, said trough having a base and two side walls, said base having width and length dimensions, said trough having a plate at each end in said length dimension, said two side walls projecting upwardly from said base in a height dimension and being positioned at opposite ends of said base in said width dimension, at least one of said two side walls having an inwardly projecting flange spaced away from said base by said height dimension; and concrete filling said trough at least up to said inwardly projecting flange, wherein said concrete and at least a portion of said inwardly projecting flange form a top surface, wherein said trough including said plate at each end in said length dimension provides a self-contained step having protection of four sides and a bottom from impact or breakage, and wherein said trough has at least one weep hole at a bottom portion of at least one plate.

2. The concrete step of claim 1, wherein each plate of said trough has at least one weep hole in a bottom portion.

3. The concrete step of claim 1, wherein each said plate has a pair of weepholes at bottom corners thereof.

4. The concrete step of claim 1, wherein said trough is made of metal.

5. The concrete step of claim 4, wherein said base and said two sidewalls are a single bent sheet of sheet metal.

6. The concrete step of claim 1, wherein said concrete lacks rebar.

7. A method for making a step, comprising the steps of:

bending a metal sheet into a trough, said trough having open-ends, a base having width and length dimensions, and two sidewalls projecting upwardly from said base in a height dimension and positioned at opposite ends of said base in said width dimension, at least one of said two sidewalls having an inwardly projecting flange spaced away from said base by said height dimension;

affixing a plate to each open-end of said trough; and filling said trough with concrete at least up to said inwardly projecting flange, wherein wet concrete is retained within said trough by said plate affixed to each open-end of said trough, wherein said concrete and at least a portion of said inwardly projecting flange form a top surface, and wherein at least one weep hole is provided at a bottom portion of at least one said plate.

8. The method of claim 7, wherein said plate is affixed by welding.

9. The method of claim 7, further comprising the step of:

finishing said concrete with one or more surface treatments.

10. The method of claim 9, wherein said one or more surface treatments comprises a surface texture or pattern, a paint, and a sealant.

11. The method of claim 7, further comprising the step of:

finishing exposed surfaces of said trough with one or more surface treatments.

12. The method of claim 11, wherein said one or more surfaces treatments comprises paint.

* * * * *